US011242604B2

(12) United States Patent
Sum et al.

(10) Patent No.: US 11,242,604 B2
(45) Date of Patent: Feb. 8, 2022

(54) CATHODE ASSEMBLY FOR THE PRODUCTION OF ALUMINUM

(71) Applicant: Tokai COBEX GmbH, Wiesbaden (DE)

(72) Inventors: Elaine Sum, Meitingen (DE); Markus Pfeffer, Meitingen (DE); Florian Pfefferer, Meitingen (DE); Oscar Vera-Garcia, Meitingen (DE); Mariusz Minkina, Meitingen (DE); Seweryn Mielnik, Meitingen (DE)

(73) Assignee: COBEX GMBH, Wiesbaden (DE)

( * ) Notice: Subject to any disclaimer, the term of this patent is extended or adjusted under 35 U.S.C. 154(b) by 0 days.

(21) Appl. No.: 16/320,195

(22) PCT Filed: Jul. 26, 2017

(86) PCT No.: PCT/EP2017/068933

§ 371 (c)(1),
(2) Date: Jan. 24, 2019

(87) PCT Pub. No.: WO2018/019910

PCT Pub. Date: Feb. 1, 2018

(65) Prior Publication Data

US 2019/0271092 A1 Sep. 5, 2019

(30) Foreign Application Priority Data

Jul. 26, 2016 (DE) ..... 10 2016 213 712.3

(51) Int. Cl.

| | |
|---|---|
| ***C25C 3/06*** | (2006.01) |
| ***C25C 3/08*** | (2006.01) |
| *C25C 3/16* | (2006.01) |

(52) U.S. Cl.
CPC . *C25C 3/08* (2013.01); *C25C 3/16* (2013.01)

(58) Field of Classification Search
CPC .... C25C 3/08; C25C 3/06; C25C 3/14; C25C 3/20; C25C 7/00; C25C 3/36; C25C 7/02; C25B 9/06; C25B 9/00
USPC ..... 204/243.1
See application file for complete search history.

(56) References Cited

U.S. PATENT DOCUMENTS 3,390,071 A * 6/1968 McMinn ..... C25C 3/08 204/247.4
2005/0218006 A1 10/2005 Bonnafous et al.

FOREIGN PATENT DOCUMENTS

| | | | |
|---|---|---|---|
| CA | 2900418 | A1 | 8/2014 |
| CA | 2 910 088 | C | 1/2018 |
| CN | 1938454 | A | 3/2007 |
| CN | 101432466 | A | 5/2009 |
| CN | 102234820 | A | 11/2011 |
| CN | 103243350 | A | 8/2013 |
| CN | 103981540 | A | 8/2014 |
| CN | 105026619 | A | 11/2015 |
| EP | 0135535 | B1 | 12/1987 |
| EP | 1845174 | A1 | 10/2007 |
| GB | 1065080 | A | 4/1967 |
| NZ | 540976 | A | 1/2007 |
| RU | 2 401 887 | C1 | 10/2010 |
| WO | 200127353 | A1 | 4/2001 |
| WO | 2010142580 | A1 | 12/2010 |
| WO | 2016079605 | A1 | 5/2016 |
| WO | 2016105204 | A1 | 6/2016 |

OTHER PUBLICATIONS

International Search Report and Written Opinion of the International Search Authority dated Dec. 18, 2017 of corresponding International application No. PCT/EP2017/068933; 10 pgs.
Canadian Office Action dated Aug. 18, 2021, in connection with CA Application No. 3,031,708; 3 pages.
Brazilian Office Action dated Jun. 17, 2021, in connection with corresponding BR Application No. 11 2019 001 196-0 (5 pp., including machine-generated English translation).
Chinese Office Action dated Sep. 10, 2021, in connection with CN Application No. 201780046358.X; 20 pages with English translation provided.

* cited by examiner

*Primary Examiner* — Zulmariam Mendez
(74) *Attorney, Agent, or Firm* — Maier & Maier, PLLC

(57) ABSTRACT

A novel cathode assembly and its use for the production of aluminum in an electrolysis cell.

14 Claims, No Drawings

CATHODE ASSEMBLY FOR THE PRODUCTION OF ALUMINUM

FIELD

The present invention relates to a novel cathode assembly and its use for the production of aluminum in an electrolysis cell.

BACKGROUND

Electrolysis cells are for example used for the electrolytic production of aluminum which, on the industrial scale, is usually carried out according to the Hall-Héroult process. In the Hall-Héroult process, a molten mixture of aluminum oxide and cryolite is electrolyzed. Here, the cryolite, $Na_3[AlF_6]$, is used to lower the melting point of 2045° C. for pure aluminum oxide to approx. 950° C. for a mixture containing a cryolite, aluminum oxide and additional substances, such as aluminum fluoride and calcium fluoride.

The electrolysis cell used in this process comprises a cathode bottom which is composed of a plurality of, for example, up to 28 adjacent cathode blocks forming the cathode. Here, the intermediate spaces between the cathode blocks are usually filled with a carbonaceous ramming paste in order to seal the cathode against molten constituents of the electrolysis cell and in order to compensate for mechanical stresses which arise as the electrolysis cell is put into operation. The cathode blocks are usually made of a carbonaceous material, such as graphite, in order to withstand the thermal and chemical conditions prevailing when the cell is in operation. The undersides of the cathode blocks are usually provided with slots in each of which one or two collector bars are arranged through which the current supplied via the anodes is discharged. Here the intermediate spaces between the collector bars and the individual cathode block walls bordering the slots are often filled with cast iron or ramming paste so that the encasement of the collector bars with cast iron thus created connects the collector bars to the cathode blocks electrically and mechanically. About 3 to 5 cm above the layer of liquid aluminum on the top side of the cathode, which is usually 15 to 50 cm thick, there is an anode, in particular formed of individual anode blocks. The electrolyte, in other words, the melt containing aluminum oxide and cryolite, is found between this anode and the surface of the aluminum. During electrolysis, which is carried out at approximately 1000° C., the aluminum thus formed, being denser than the electrolyte, settles below the electrolyte layer—in other words, as an intermediate layer between the top side of the cathode and the electrolyte layer. In electrolysis, the aluminum oxide dissolved in the melt is separated into aluminum and oxygen by the electrical current flow. From the electrochemical point of view, the layer of liquid aluminum is the actual cathode since aluminum ions are reduced to elemental aluminum on its surface. Nonetheless, in what follows, the term cathode will not refer to the cathode from the electrochemical point of view, in other words, the layer of liquid aluminum, but rather to the component composed, for example, of one or more cathode blocks and forming the bottom of the electrolysis cell.

If the intermediate spaces between the collector bars and the individual cathode block walls bordering the slots are filled with cast iron a so-called rodding step is necessary. During this rodding step the cathode block is preheated and molten cast iron is poured into the gap between the collector bar and the cathode block walls bordering the slots and allowed to solidify by cooling wherein the cast iron is shrinking. During the startup of the electrolysis cell the cast iron is expanding, but it is never reaching again the same temperature as the molten iron. Due to differential thermal expansion, the contact between the cast iron and the cathode block is not uniform on all surfaces in the slot. Hence, the electrical contact between the collector bar, cast iron and the cathode block is uneven resulting in a higher electrical resistance and a higher cathode voltage drop of this arrangement and thus a poor energy efficiency of the electrolytic process. Furthermore, the rodding step requires time and takes up between 40 and 60% of the total cost of a cathode assembly to the smelter and this step may be associated with health and safety issues.

If, instead of cast iron, carbonaceous ramming paste is used, health and environmental issues may arise due to the fact that these ramming pastes normally contain polyaromatic hydrocarbons. However, the use of carbonaceous ramming paste does not require a melting step as the use of cast iron does.

WO 2016/079605 describes a cathode arrangement wherein instead of a collector bar made of steel a collector bar made of a highly electrically conductive metal like copper is used. The corresponding collector bar can be in direct contact with the cathode block, i.e. neither cast iron nor a carbonaceous ramming paste is used and this bar is located horizontally within the cathode block. The parts of these collector bars extending outwards are connected to a steel connector bar having a greater cross-sectional area than the connected collector bar and this steel connector bar is connected to an external current supply. The steel connector bar and the collector bar made of a highly electrically conductive metal overlap one another partially and are secured together for example by welding, by clamping or they are threaded together. The purpose of this arrangement of collector bar and steel connector bar is to reduce voltage drop and to assure thermal balance of the cell. WO 2016/079605 does not address the problems of mechanical robustness and chemical protection related to transport, handling, installation, cell bake and start-up and cathode heave during the life of a cell, typically 3-6 years.

SUMMARY

It is therefore the object of the present invention to provide a cathode assembly which dispenses with cast iron or carbonaceous ramming paste and which can be directly connected to the external bus bar system, i.e. which can be directly installed in the electrolysis cell upon delivery. Furthermore, this cathode assembly should provide a more homogeneous current distribution within the cathode blocks and a reduced voltage drop.

According to the present invention, this object is solved by a cathode assembly for the production of aluminum comprising at least one cathode block on the basis of carbon and/or graphite, at least one current collector system of a highly electrically conductive material having an electrical conductivity greater than that of steel, wherein the terminal end parts of the at least one current collector system are extending outside of the at least one cathode block and/or, preferably or, are within the at least one cathode block characterized in that at least one part, preferably all parts, of the at least one current collector system is/are sloping upwards when viewed over the length of the cathode block.

Within the context of the present invention, a current collector system is to be understood as a system whose geometry and position results in an effective electrical contact surface or a series of electrical contact points with the at least one cathode block.

Furthermore, within the context of the present invention, the term "sloping upwards" when viewed over the length of the cathode block means that the corresponding part of the current collector system or the complete current collector system has independently from each other an angle of more than 0° with respect to the longitudinal horizontal plane of the cathode block, i.e. it is possible that each corresponding part of the current collector system and/or different current collector systems have different angles. The angle can go from more than 0° to 90° wherein the choice of angle, in particular the maximum possible angle, depends on the length and height of the cathode block. Preferably, an angle between 1° and 12°, more preferably between 3° to 10° is chosen. In this context, longitudinal plane is to be understood as the plane which extends in the direction of the longitudinal axis of the cathode block. A current collector system wherein at least one part is sloping upwards can have for example the form of a trapezoid or a semi-ellipsoid, when viewed from the side. If such a current collector system has the form of a trapezoid the two sides thereof are formed by two parts of the current collector system sloping upwards starting from the outer ends of the cathode blocks and top of the trapezoid is a part of the current collector system connecting the two sloping parts, however it is not necessary that this part is actually physically connecting these two sloping parts. The bottom side of the cathode block can be regarded as the base of the trapezoid. A current collector system wherein all parts are sloping upwards can have for example the form of a triangle wherein the sides of this triangle are formed by two parts of the current collector system sloping upwards starting from the outer ends of the cathode block and the base of this triangle is formed by the bottom side of the cathode block.

According to the invention, it was realized that the cathode voltage drop of a cathode arrangement can be reduced by using at least one current collector system formed of a highly electrically conductive material having an electrical conductivity greater than that of steel wherein at least one part, preferably all parts of the current collector system, is/are sloping upwards. Due to the use of a highly electrically conductive material having an electrical conductivity greater than that of steel the electrical contact between the cathode block based on carbon and/or graphite and the current collector system is improved as most, if not all of the surface of this current collector system is in intimate contact with the cathode block resulting in a lower electrical resistance. Thus, the cathode voltage drop is reduced. In addition, the vertical current distribution over the length of the cathode block is more uniform when the correct position and geometry of the current collector system is chosen. The use of a current collector system which is at least partially sloping upwards results in an essentially homogeneous vertical current distribution over the cathode block length wherein the cathode voltage drop is further reduced. Thus by reducing the cathode voltage drop the energy efficiency of the electrolytic cell is improved.

Apart from that, by using the above current collector system, no cast iron or carbonaceous ramming paste is needed in order to create the electrical contact between the commonly used steel collector bars and cathode blocks. Costs are reduced as no rodding step is necessary and safety and health issues related to the rodding step can be prevented. Furthermore, as the dimensions of these current collector systems can be much smaller compared to the conventional steel bars, costs are further reduced, longer cell life is possible due to more cathode material between cathode surface and collector system and cell cavity can be enlarged by reducing the cathode height.

According to a preferred embodiment of the present invention, the current collector system has at least one insert having a non-branched or a branched configuration, preferably a non-branched configuration.

An insert having a non-branched configuration can preferably be a rod, a bar or a thin plate wherein these inserts have for example a rectangular or cylindrical form in cross-section. Normally, these inserts are one piece. However, in the context of the invention it is possible that the one piece insert is replaced by two half-inserts. When the trapezoidal or triangular form of the current collector system is used, the corresponding current collector system can be made of one piece or it can be made of two or three inserts being put together in order to get the triangular or trapezoidal form. The use of such inserts, with space in between them, allows for thermal expansion, in particular lengthwise thermal expansion. If there is no allowance for thermal expansion the inserts may buckle and deform and as a consequence exert stresses on the cathode block and surrounding material. Depending on the design of the cathode assembly it is also possible that at least two inserts are placed in parallel spaced apart also allowing for thermal expansion and thermo-mechanical stresses exerted on the cathode material in between. It is to be understood that the geometry of the inserts, in particular the cross section thereof, and the number of inserts is chosen in order to minimize the amount of highly electrically conductive material and therefore, costs, heat loss and contact resistance, and to have uniform current distribution and therefore, cell stability.

An insert having a branched configuration can be a rod, a bar or a thin plate comprising a horizontal or sloping part wherein at intervals at least one vertical part is extending upwards. If more than one vertical part is used the endpoints of these parts form a slope, i.e. the height of these vertical parts is increasing from the outer ends of the cathode blocks to the center thereof. The endpoints of these branches build a series of electrical contact points with the at least one cathode block. It is also possible that the insert has the form of a mesh. The advantage of using such a branched configuration is that less of the highly electrically conductive material is needed, as it can be utilized in a minimum amount and only at the points where it is needed. In certain situations, a branched configuration may be easier to manufacture, e.g. embedding a mesh or network of conductors within a cathode body during forming or inserting them in one half and then closing with another half of the cathode body.

The at least one insert is preferably embedded in a slot and/or in a through-hole of the cathode block. The slot is machined according to the dimensions of the insert and the through-hole can be drilled into the cathode block also according to the dimensions of the corresponding insert. By having such a slot or through-hole, thermal expansion of the insert is allowed as the insert can expand within the space provided by either the slot or the through-hole.

According to a further preferred embodiment of the present invention, the highly electrically conductive material is selected from the group consisting of metals, alloys, metal carbon composites, graphenes, graphites and carbon composites.

Within the context of the present invention it is to be understood that a metal carbon composite can be metal matrix composites (e.g. carbon or graphite particles or fibres in a metal matrix), or materials derived metal carbon composite powders, or materials derived from metal and carbon powders made, for example, by powder metallurgy or a metal impregnated carbon or metal coated carbon fibres or metal bonded carbon fibre reinforced composites or metal graphite composites.

According to the invention graphites can be selected from natural, synthetic, pyrolytic or expanded graphite and carbon composites can be selected from carbon fibre/carbon composites or graphite/carbon composites.

It is preferred that the highly electrically conductive material is a metal or an alloy, preferably copper, silver or a copper alloy, more preferably copper. A copper alloy can be an alloy with silver or aluminum. As copper, the commercially available ETP (Electrolytic Tough Pitch Copper), oxygen free and CuAg0.1P grades can be used. It is preferred that these highly electrically conductive materials have a melting point above the temperature of the cathode block during cell operation, which is typically between 850 and 950° C.

According to another preferred embodiment of the present invention there is either a direct contact between the at least one cathode block and the at least one current collector system or at least one layer of electrically conductive material is in between the at least one cathode block and the at least one current collector system.

If there is a direct contact between the cathode block and the current collector system, the electrical contact results from the weight of the cathode block and from the controlled thermal expansion and ductility of the current collector system. In the case of direct contact where there is no intermediate conductive layer such as graphite or metal foil, good electrical contact (low contact resistance) between cathode and current collector insert is achieved by having a precise fit between the insert and slot or through-hole and allowing for thermal expansion from heat up to final cell temperature. The insert is selected from materials which have a larger coefficient of thermal expansion than that of the cathode. The differential thermal expansion ensures a good fit and electrical contact. The contact resistance of cathode/current collector interface is lower than 10 $\mu Ohm \cdot m^2$, preferably lower than 5 $\mu Ohm \cdot m^2$, and more preferably lower than 1 $\mu Ohm \cdot m^2$, from room temperature to cell service temperature, typically 850-950° C. within the cathode.

The current collector system can be smooth or roughened depending on the type of carbon surface. A smooth surface may be preferable for graphitized cathode materials while a rough surface may suit an amorphous cathode material better. If a rough surface provides better contact to the carbon, these rough surfaces can be obtained by using methods like sandblasting, emery polishing, shot blasting, grinding, oxidation, or etching.

In order to create or improve the electrical contact between the cathode block and the current collector system, where there is a gap to be bridged or poor fit, it is also possible that at least one layer of electrically conductive materials acting as a conductive interface is in between the cathode block and the current collector system. Preferably, the electrically conductive material is selected from the group consisting of a graphite foil, preferably an expanded graphite foil, a foil, cloth, mesh, foam or paste of a metal or an alloy, preferably copper or a copper alloy, or a conductive glue or any arbitrary mixture thereof. One further function of these electrically conducting materials is to compensate for the different thermal expansions of the highly electrically conductive material relative to the carbonaceous material of the cathode block. If more than one layer of an electrically conductive material, for example expanded graphite, is used the layer structure can increase certain required properties like for example the electrical conductivity.

In yet another preferred embodiment of the present invention the terminal end parts of the at least one current collector system extending outside and/or being within the at least one cathode block are connected to an external bus bar system by a conductive coupling link. In case the terminal end parts of the at least one current collector system are extending outside, they can join together at the conductive coupling link.

In the context of the present invention a conductive coupling link can be a steel bar, a bimetallic plate, a flexible part, a carbon part, a graphite part or any arbitrary combination thereof like a steel bar in combination with a bimetallic plate. The main function of these conductive coupling links is to electrically connect the current collector system to the external busbar system in such a way that allows the smelter to employ the conventional busbar connection methods, for example welding or clamping. Other functions include providing mechanical stability, allowing for movement due to cathode heave or to balance the thermal management within the electrolytic cell, whereby these conductive coupling links reduce the heat flux.

The above carbon part can be made of carbon fibers, preferably coated or metal impregnated carbon fibers and a graphite part can be made of graphite fibres or metal coated or impregnated graphite fibres. These parts can be used on their own or they are encased in a rigid metal housing or a flexible metal tube.

If a steel bar is used as conductive coupling link, this steel bar can connect to the terminal end parts of the current collector system outside and/or within the cathode block. The cross section of this steel bar is increased compared to the terminal ends of the current collector system in order to reduce the voltage drop and in order to assure the thermal balance of the cell. The length of the steel bar and the overlap between steel and the terminal parts of the current collector are not fixed, but rather depend on the targeted cathode voltage drop, current density distribution and heat loss in the cell design and the amount of mechanical stability required. An electrically insulating material, e.g. mortar or ceramic fibre blanket/sheet, can be placed between the steel and the cathode to prevent stray current bypassing the current collector system embedded within the cathode. The insulation material may also extend some distance further into the cathode between current collector system and cathode, if required for achieving the desired current distribution but at the expense of some increase in cathode voltage drop.

The terminal end(s) of the current collector system can be plugged into the steel bar(s), i.e. there is a partial overlap between the steel bar and the current collector system, or these two parts can be secured together by welding, by applying electrically conductive glue, by clamping or other mechanical fixation or the joint between the terminal end(s) and the steel bar(s) is closed by thermal expansion. It is also possible to combine these securing methods in any desired way. The steel bar provides mechanical support to the current conductor system and takes some stress from the current conductor system if the cathode block accommodating this current conductor system heaves. Furthermore, the mechanical handling of the cathode assembly comprising such a steel bar during transport and installation is improved.

If the conductive coupling link represents a bimetallic plate, each side thereof is preferably made of the same material as the component it is facing. Such a bimetallic plate can be welded to the terminal end(s) of the current conductor system extending outside and joined to the external bus bar system by means of clamping or welding. The side of the bimetallic plate facing the current collector system is made of the same material as this current collector system, e.g. copper. The other side of the bimetallic plate facing the external bus bar system is made of the same material as the connection surface of this bus bar system, e.g. aluminum, copper or steel. This choice of material facilitates the connection to either the current collector system or the external bus bar system. Furthermore, the same material ensures ease of joining, good bonding and similar electrical conductivity, avoids corrosion arising from different electrochemical potential between dissimilar materials in the presence of any electrolyte, e.g. moisture, and avoids interdiffusion of different materials which would alter the local chemical composition and microstructure and therefore the physical properties such as mechanical and electrical behaviour.

It is preferred that in case a steel bar is used as a conductive coupling link, it is combined with a bimetallic plate, in the case where the busbar connection surface is not steel and the connection is made by welding for example. The bimetallic plate is placed between the steel bar and the external bus bar system. The side of the bimetallic plate facing the steel bar is also made of steel. Due to this combination the connection to the busbar is made easier and remains the same as the conventional method adopted by the smelter where applicable. The other advantages are mentioned above.

The size of these bimetallic plates is at least the same size as the cross-section of the steel bar and can be larger, depending on the smelter's practice.

It is also possible that the conductive coupling link represents a flexible part which is commercially available. The flexible part is made of a material selected from the group consisting of carbon, graphite, copper, aluminum, silver and any arbitrary mixture or combination thereof, preferably copper or aluminum, more preferably copper. This flexible part is preferably braided or laminated. Due to the flexibility of these parts, installation of the cathode assembly is easier and movement of the cathode due to cathode heave or other forces is accommodated during the life of the cell.

An attachment device, preferably a steel plate, is attached to the side and/or bottom of the cathode block from which the terminal end parts are extending. This attachment device serves to mechanically support the coupling link and/or protective casing surrounding the protruding part of the current collector system. It is preferably a mechanical attachment. Screws, bolts or pins, preferably being of the same metal as the plate, can be used for mechanically fixing the plate to the cathode block. This plate has at least one opening having a size being barely larger than the cross-section of the terminal ends of the current collector system extending outside of the cathode block or of the steel bar acting as a conductive coupling link. In order to prevent current flowing between the metal plate and the cathode block it is possible to place electrical insulators such as pliable refractory self-adhesive sheets in between and in order to prevent current flowing through the mechanical fixation device (screw, bolt or pin) to the metal plate, insulating washers can be placed in between.

In yet another preferred embodiment of the invention at least a part, preferably all of the terminal end(s), of the current collector system extending outside are encased by a protective casing. This casing is made of a metal, preferably of steel. It is preferred that the protective casing is attached to the cathode block by a metal plate, preferably a steel plate, as described above. The protective casing provides part of the mechanical stability of the inventive cathode assembly, in particular when this assembly is transported and handled and when it is in service, and this protective casing protects from chemical impacts like from corrosive gases during start up and operation of the electrolysis cell and contact of current collector system with molten aluminium or bath if there is a leak in the joint between cathode blocks or the large peripheral joint between end of cathode block and the sidewall of the cell.

In an even more preferred embodiment of the invention the space between the terminal ends of the current collector system extending outside and the protective casing is filled with a compressible material having a low electrical conductivity similar to refractory insulation materials and no higher than that of coke or charcoal and a low thermal conductivity of 0.05 to 20 W/m·K, preferably a material being an electrical insulator and having a low thermal conductivity in the range of 5-10 W/m·K. This material based on ceramic materials or carbon, more preferably a material based on ceramic materials or amorphous carbon, even more preferably ceramic fiber sheets, ceramic fiber wool, granules, anthracite, coke, carbon black, carbon felts, most preferably ceramic fiber sheets, ceramic fiber wool or granules. The filling material allows movement or deformation of the encased part of the current collector system as a consequence of cathode heave or other forces and it supports the thermal as well as the electrical management of the electrolytic cell. In combination with the cell lining design and the conductive coupling link, the thermal conductivity of the filling material influences the heat flux and temperature at the terminal ends of the current collector system, and contributes to the thermal balance of the cell.

The cathode assembly according to the invention comprises at least one cathode block on the basis of carbon and/or graphite. Preferably, the composition of the cathode block comprises at least 50% by weight, more preferably at least 60% by weight, even more preferably at least 80% by weight, especially preferably at least 90% by weight and most preferably at least 95% of carbon and/or graphite.

The carbon can be amorphous carbon such as anthracite and the graphite can be natural graphite and/or synthetic graphite. In the context of the invention, if the at least one cathode block represents a layered cathode block, it also possible to mix the carbon and/or graphite with a refractory hard metal, preferably $TiB_2$ and such a mixture represents the upper layer of the cathode block whereas the lower layer of the cathode block is of carbon and/or graphite.

In yet another preferred embodiment of the present invention the at least one cathode block of the cathode assembly comprises at least one electrically active part and one at least one electrically inactive part. In the context of the invention the electrically active part is defined by the presence of current lines flowing from the cathode surface to the current collector system whereas the electrically inactive part is defined by the absence of current lines. The electrically inactive part is preferably situated below the current collector system. The electrically active part is preferably made of carbon and/or graphite as defined above. The electrically inactive part is preferably made of carbon, or a refractory material. Any arbitrary combination of the materials of the electrically active part and the electrically inactive part may be used. The function of the electrically inactive part is to give mechanical stability to the at least one current collector system and to be a chemically inert barrier to protect the at least one current collector system from gaseous oxidation or corrosion. Furthermore, the electrically inactive part is preferably made of a material which is cheaper than the material of which the electrically active part is made, i.e. costs can be reduced. Examples of refractory material in the role of the electrically inactive part include mortar, castable refractories, quick-setting sol-gel refractory products and concrete. Castable or quick-setting sol-gel refractory products are useful for filling in large or irregularly shaped spaces. The electrically insulating parts in combination with the geometry and positioning of the current collector system help to achieve the desired current distribution in the cell.

It is preferred that the at least one electrically active part and the at least one electrically inactive part each has a varying thickness when viewed over the length of the cathode block, more preferably the at least one electrically inactive part has a shallower thickness at its outer end than at its center, corresponding to the centre of the whole cathode, and the at least one electrically active part has a higher thickness at its outer ends than at its center, which is also the centre of the whole cathode.

According to the invention it is also possible that the at least one cathode block comprises at least two electrically active parts which are spaced apart and wherein at least one electrically inactive part is filling the gap between the at least two electrically active parts, the electrically inactive gap being in the centre of the whole cathode block in the vicinity of the centre channel below the alumina feeders. These electrically active parts have a higher thickness at or near the outer cathode end than at or near the center of the cathode. Preferably, these electrically active parts each comprise at its outer end a part representing an electrically inactive part. By using more electrically inactive material and confining the electrically active part to the cathode region directly below the anodes, costs can be further reduced. The two electrically inactive parts at the outer ends of the electrically active parts ensure a better distribution of the current along the length of the cathode block.

Furthermore, the present invention relates to the use of a previously described cathode assembly for carrying out a fused-salt electrolysis to produce aluminum.

In a conventional electrolysis cell based on Hall-Héroult technology there are gaps between cathode blocks (called short joints) and between the cathode blocks and the sidewall refractories (called peripheral or big joints). These gaps are normally filled with ramming paste; the big joints may also be filled partially or completely with prebaked carbon blocks wherein the corresponding rammed or carbon surface is sloping upwards from the cathode surface to the sidewall. The sidewall blocks adjacent to the steel shell are made of silicon carbide, which is expensive, or carbon. The sub-cathodic lining, i.e. the lining below the cathode blocks, can also be made of ceramic materials.

The environmental, health and safety benefits resulting from eliminating rodding by cast iron or ramming paste through the use of the present invention can be further enhanced by installing such cathode assemblies in an electrolysis cell for producing aluminum where at least one big joint, preferably all big joints, is/are not filled with ramming paste but with a quick-setting sol-gel refractory product which is already commercially available or may be modified to suit the aluminium smelting cell environment.

Ramming paste involves the use of tar binder and other carbonaceous binders which all give off hazardous polyaromatic hydrocarbons (PAH) during bake-out. Even the so-called environmentally friendly binders produce small quantities of PAH upon carbonization. The ramming operation is done manually during cell construction. Working conditions are usually unpleasant and there are ergonomic issues to consider. Substitution with inorganic products would eliminate these hazards and PAH emissions resulting in a paste free cell.

An inorganic product such as the quick-setting sol-gel refractories is favoured over more traditional castable products because they contain chemically bound water which must be released slowly under controlled heating conditions to avoid cracking. This constraint restricts in-situ application to very small quantities or thin layers. All water must be removed during cell bake-out, well before the introduction of molten bath and aluminium metal to avoid a disastrous molten metal explosion.

Sol-gel refractories are applied in blast furnaces, glass furnaces and aluminium casting furnaces. There are formulations which are resistant to molten metal and can even be applied to a hot working furnace. The colloidal binder system can be adjusted to suit application temperatures and rapid setting times. As water is only physically bound in sol gel refractories, they can be safely removed at temperatures below 100° C., well before the relined cell is started up in the potline.

In a further preferred embodiment of the present invention the short joints between carbon cathode blocks can be replaced with sol-gel refractory or thin graphite foil (the use of thin graphite foil is described in WO2010/142580 A1). The functional requirements for the big joint around the periphery of the cathodes are different from the small joints. Apart from sealing the cell bottom from bath and metal leakage, the big joint has to keep the cathode blocks immobile and pressed together under compression.

In yet another preferred embodiment of the present invention a sol-gel pumpable slurry refractory is replacing all rammed big joints and is replacing the expensive SiC sidewall with cheaper carbon sidewall covered with an oxidation protection coating on the top and outer surfaces and with an artificial ledge on the inner surface, all of which are formed by the same type of sol-gel refractory slurry but whose composition and properties are modified to suit the functional requirements of each part of the aluminium reduction cell. As the sol-gel refractory in the big joint(s) is electrically insulating, the refractory components between the cathodes and steel shell wall could be replaced with carbon blocks of low thermal conductivity.

The present invention also relates to an aluminum cell which does not contain any ramming paste, a so-called paste-free cell. Such a paste-free cell comprises cathode assemblies according to the present invention, sol-gel refractory coated carbon sidewalls, sol-gel refractory big joints, graphite foil or sol-gel refractory short joints; in such a case, all joints, i.e. all short and big joints, are not filled with any ramming paste. Preferably, ceramic refractories are used in the sub-cathodic lining and around collector bars. Such a cell eliminates all the health, safety and environment problems associated with ramming paste.

The sol-gel slurry refractory is pumpable and easily applied on site during cell construction (as a commercially available product Metpump from Magneco/Metrel Inc., Illinois/US, may be used). Its chemical and physical properties are adapted to the functional requirements by choice of composition. The key ingredient is a suitable colloidal binder involving the release of physical water which allows quick drying at low temperatures (100-200° C.) without cracking. All water will be released during the first part of cell bake-out below 200° C. before any molten cryolite or aluminium is added, so there should be no problem of a steam or molten metal explosion. The rheology of the slurry allows it to flow and fill up the gaps fully, ensuring a good seal in the big joint, small joints (if graphite foil not used) and in the gap between sidewall block and steel shell wall. It is known to expand during heat up to service temperature, rather than shrink, again ensuring a good seal in the big joint and keeping the cathode blocks and graphite foil under compression.

The chemical resistance depends on the choice of slurry filler material to match the service environment. For example, the sol-gel refractory in the big joint must be resistant to molten aluminium and will probably be the same or similar to that used in aluminium casthouse furnace linings. On the carbon sidewall, it would be the SiC rich composition for air oxidation protection. As an artificial ledge on the inner surface of the carbon sidewall, it is probably the alumina rich composition for sufficient resistance to cryolite and aluminium metal until natural ledge forms.

The invention claimed is:

1. Cathode assembly for the production of aluminum comprising:

at least one cathode block on the basis of carbon and/or graphite, at least one current collector system completely made of a highly electrically conductive material having an electrical conductivity greater than that of steel, wherein the terminal end parts of the at least one current collector system are extending outside of the at least one cathode block and/or are within the at least one cathode block wherein at least one part of the at least one current collector system is sloping upwards when viewed over the length of the cathode block, and wherein the highly electrically conductive material is copper or a copper alloy.

2. Cathode assembly according to claim 1, wherein the at least one current collector system has at least one insert having a non-branched or a branched configuration.

3. Cathode assembly according to claim 1, wherein the highly electrically conductive material is selected from the group consisting of metals, alloys, metal carbon composites, graphenes, graphites and carbon composites.

4. Cathode assembly according to claim 3, wherein the highly electrically conductive material is a metal or an alloy.

5. Cathode assembly according to claim 1, wherein there is either a direct contact between the at least one cathode block and the at least one current collector system or at least one layer of electrically conductive material is in between the at least one cathode block and the at least one current collector system.

6. Cathode assembly according to claim 1, wherein the terminal end parts of the at least one current collector system extending outside of the at least one cathode block and/or being within the at least one cathode block is connected to an external bus bar system by a conductive coupling link.

7. Cathode assembly according to claim 6, wherein the conductive coupling link is selected from a steel bar, a bimetallic plate, a flexible part, a carbon part, a graphite part or any arbitrary combination thereof.

8. Cathode assembly according to claim 7, wherein each side of the bimetallic plate is made of the same material as the component it is facing.

9. Cathode assembly according to claim 7, wherein the flexible part is made of a material selected from the group consisting of carbon, graphite, copper, aluminum, silver and any arbitrary mixture or combination thereof.

10. Cathode assembly according to claim 1, wherein if the conductive link is a bimetallic plate or a flexible part or at least a part of the terminal end parts of the at least one current collector system protrudes from the cathode block, the part or parts of the at least one current collector system extending outside and part or all of the conductive link are encased by a protective casing.

11. Cathode assembly according to claim 10, wherein the space between the at least one current collector system and the protective casing is filled with a compressible material having a low electrical conductivity and a low thermal conductivity.

12. Cathode assembly according to claim 1, wherein the at least one cathode block is composed in a proportion of at least 50% by weight of carbon and/or graphite.

13. Cathode assembly according to claim 1, wherein the at least one cathode block comprises at least one electrically active part and at least one electrically inactive part.

14. Cathode assembly according to claim 13, wherein the at least one electrically active part is made of carbon and/or graphite and the at least one electrically inactive part is made of carbon, or refractory material, or any arbitrary combination thereof.

* * * * *